US008099003B2

(12) United States Patent
Suzuki et al.

(10) Patent No.: US 8,099,003 B2
(45) Date of Patent: Jan. 17, 2012

(54) IMAGE FORMING APPARATUS AND IMAGE FORMING METHOD FOR ELIMINATING IMAGE DEFECTS BY CONSIDERING A KIND OF TRANSFER MATERIAL

(75) Inventors: Takehiko Suzuki, Suntou-gun (JP); Masahiko Suzumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 504 days.

(21) Appl. No.: 12/258,755

(22) Filed: Oct. 27, 2008

(65) Prior Publication Data

US 2009/0110419 A1 Apr. 30, 2009

(30) Foreign Application Priority Data

Oct. 31, 2007 (JP) ..... 2007-283755
Oct. 3, 2008 (JP) ..... 2008-258311

(51) Int. Cl.
*G03G 15/00* (2006.01)

(52) U.S. Cl. ..... 399/45

(58) Field of Classification Search ..... 399/45, 399/50

See application file for complete search history.

(56) References Cited

U.S. PATENT DOCUMENTS

| | | | | |
|---|---|---|---|---|
| 4,803,520 | A | 2/1989 | Tomosada et al. | |
| 4,821,068 | A | 4/1989 | Honma et al. | |
| 4,862,219 | A | 8/1989 | Yoshida et al. | |
| 4,870,447 | A | 9/1989 | Yoshida et al. | |
| 5,115,273 | A | 5/1992 | Ujiie et al. | |
| 5,251,023 | A | 10/1993 | Arimoto et al. | |
| 5,377,321 | A | 12/1994 | Kaneko et al. | |
| 5,552,858 | A | 9/1996 | Ujiie et al. | |
| 5,608,505 | A | 3/1997 | Takeuchi et al. | |
| 5,768,657 | A | 6/1998 | Kimura et al. | |
| 5,905,581 | A | 5/1999 | Suzuki et al. | |
| 6,023,595 | A | 2/2000 | Suzuki et al. | |
| 6,181,819 | B1 | 1/2001 | Arimoto et al. | |
| 6,226,469 | B1 | 5/2001 | Suzuki et al. | |
| 6,385,409 | B2 | 5/2002 | Suzuki et al. | |
| 6,819,452 | B1 * | 11/2004 | Richtsmeier et al. | 358/1.9 |
| 2004/0223174 | A1 | 11/2004 | Mikami | 358/1.9 |
| 2005/0158062 | A1 * | 7/2005 | Yamada et al. | 399/45 |

FOREIGN PATENT DOCUMENTS

| | | | |
|---|---|---|---|
| JP | 2000-175029 | | 6/2000 |
| JP | 2002-166602 | | 6/2002 |
| JP | 2004-230846 | | 8/2004 |
| JP | 2005-208403 | A | 8/2005 |
| JP | 2006-145751 | A | 6/2006 |
| JP | 2007-034234 | A | 2/2007 |
| JP | 2007-62037 | | 3/2007 |

* cited by examiner

*Primary Examiner* — Quana M Grainger

(74) *Attorney, Agent, or Firm* — Fitzpatrick, Cella, Harper & Scinto

(57) ABSTRACT

An image forming apparatus and method which can take a countermeasure against a tail or the like in consideration of differences of various conditions such as a kind of transfer paper and the like is provided. The apparatus has an image processing portion for extracting an image pattern whose image information has a concentration of 100% and executing a thin-out process for thinning out a predetermined area in the extracted image pattern at a predetermined ratio. The image processing portion or step changes the thin-out process according to the transfer paper kind.

11 Claims, 9 Drawing Sheets

FIG. 5

| CHARGING BIAS CONDITIONS | DEVELOPING BIAS CONDITIONS | ENVIRONMENT CONDITIONS (ATMOSPHERE TEMPERATURE, HUMIDITY) | | |
|---|---|---|---|---|
| | | LESS THAN 5.0g/m$^3$ | 5.0 TO 15.0g/m$^3$ | LARGER THAN 15.0g/m$^3$ |
| CHARGE A (-650V OR LESS) | DEVELOPMENT A (-150V OR MORE) | 0.8 | 0.7 | 0.6 |
| | DEVELOPMENT B (-300 TO -150V) | 0.7 | 0.6 | 0.5 |
| | DEVELOPMENT C (-300V OR LESS) | 0.6 | 0.5 | 0.4 |
| CHARGE B (-650 TO -450V) | DEVELOPMENT A (-150V OR MORE) | 0.7 | 0.6 | 0.5 |
| | DEVELOPMENT B (-300 TO -150V) | 0.6 | 0.5 | 0.4 |
| | DEVELOPMENT C (-300V OR LESS) | 0.5 | 0.4 | 0.3 |
| CHARGE C (-450V OR MORE) | DEVELOPMENT A (-150V OR MORE) | 0.6 | 0.5 | 0.4 |
| | DEVELOPMENT B (-300 TO -150V) | 0.5 | 0.4 | 0.3 |
| | DEVELOPMENT C (-300V OR LESS) | 0.4 | 0.3 | 0.2 |

IMAGE FORMING APPARATUS AND IMAGE FORMING METHOD FOR ELIMINATING IMAGE DEFECTS BY CONSIDERING A KIND OF TRANSFER MATERIAL

BACKGROUND OF THE INVENTION

1. Field of the Invention

The present invention relates to an image forming apparatus and an image forming method using an electrophotographic technique and, more particularly, to a mechanism for coping with a defect occurring in a fixing step of fixing a toner image in an image forming process.

2. Description of the Related Art

A laser beam printer (hereinbelow, also referred to as an LBP) as an image forming apparatus using an electrophotographic technique has been used hitherto.

In the LBP, a photosensitive drum is uniformly charged by a charging roller. After that, a scanner modulates an intensity of a laser beam based on an image signal included in data of a print job sent from a host computer, thereby forming an electrostatic latent image onto the photosensitive drum. Toner is deposited onto the electrostatic latent image on the photosensitive drum by a developing roller, thereby forming a toner image. The toner image on the photosensitive drum is transferred onto a transfer material by a transfer roller. After that, the toner image on the transfer material passes through a conveying belt, a fixing roller, and a pressing roller and becomes a permanent fixed image. The transfer material is stacked onto a tray by a discharge roller.

In the ordinary printer, as illustrated in FIGS. 8 and 9, when a straight line image 1302 in the main scanning direction is output, the following problem would be occur. That is, in a fixing step, there is such a problem that in a line image visualized as a toner image on a transfer material 1301, the toner is scattered at a trailing edge in the sub-scanning direction (also referred to as a downstream in the sub-scanning direction), so that the image is disturbed (such a phenomenon is referred to as a "tail" illustrated at 1303 in the diagrams).

Such a phenomenon occurs because moisture in the transfer material is explosively evaporated due to a sudden temperature increase in the fixing step and a pressure by a fixing apparatus (a fixing roller 1209*a* and a pressing roller 1209*b*), the steam comes out of the trailing edge of a weak force and, at the same time, the toner is also scattered (FIG. 9). Generally, there is a correlation between the tail and a toner amount. The larger the toner amount is, the more the tail is liable to occur.

There is an offset phenomenon as another image defect which occurs in such a printer. The offset phenomenon is that when the non-fixed toner image is fixed by the fixing apparatus, the toner image is electrostatically transferred to the fixing roller 1209*a* and the toner image is fixed to another portion of the transfer material 1301 and becomes an offset image. Also with respect to the offset phenomenon (also simply referred to as an offset hereinbelow), in a manner similar to the tail, the larger the toner amount is, the more the offset is liable to occur.

As a method of solving such a problem, for example, as disclosed in Japanese patent application Laid-Open No. 2000-175029, there is a method whereby an image area portion is thinned out at a predetermined ratio and the toner amount is reduced.

SUMMARY OF THE INVENTION

However, according to the above related art, the thin-out process is executed irrespective of a difference of conditions such as kind of transfer material, environment, and the like. There is, consequently, a case where if the transfer material changes or a use environment differs, occurrence amounts of the tail and offset differ.

Particularly, in the case of the fixing apparatus using a metal film such as SUS as a fixing member, the foregoing difference of the kind of transfer material appears typically as a difference of the tail or offset.

The above phenomenon will be described in detail with reference to FIGS. 10 and 11.

FIG. 10 illustrates a film heating and fixing apparatus using a resin film such as PI. An endless-shaped resin film 1401*a*, a heater 1403 such as ceramics, a heater holder 1402*a* for supporting the heater, the pressing roller 1209*b*, and the transfer material 1301 are illustrated in the diagram. In such a fixing apparatus, the tail is reduced by the following method. That is, by projecting a part on the upstream side of the heater holder 1402*a* in an A portion surrounded by a broken circle in the diagram, the resin film 1401*a* and the transfer material 1301 are come into contact with each other at a position in front of a nip portion. Thus, the toner is melted by a certain extent at the position in front of the nip portion (pre-heat) and the tail is reduced. If such a heater holder shape is used, a portion where a curvature of the film is very small exists on the upstream of the nip portion. However, since a rigidity of the resin film 1401*a* is small, even if the curvature decreases, the resin film can be used without a problem.

However, in the case of using the metal film such as SUS, if a curvature of the film decreases, a crack is caused by a metal fatigue due to a bending in such a portion. Therefore, in the case of using the metal film, since the heater holder shape for the resin film 1401*a* cannot be used, it is necessary to use a heater holder shape in which the curvature on the upstream of the nip portion is suppressed as illustrated in a B portion surrounded by a broken circle in FIG. 11. Therefore, in the case of using a metal film 1401*b*, the tail due to the pre-heat at the position in front of the nip portion cannot be reduced. As mentioned above, in the case of using the metal film 1401*b*, the tail reducing effect which is obtained as a fixing apparatus decreases and a tail level changes largely according to the changes in the transfer material and the environment.

The endless-shaped metal film (metal belt) 1401*b*, the heater (slide member) 1403 such as ceramics, a heater holder (supporting member) 1402*b* for supporting the heater, the pressing roller (pressing member) 1209*b*, and the transfer material 1301 are illustrated in FIG. 11. The metal film 1401*b* is a metal belt having a thickness of about 30 μm and rotates along an outer edge of the heater holder 1402*b* in association with a rotation of the pressing roller 1209*b*. At this time, a nip portion is formed between the heater 1403 and the pressing roller 1209*b* through the metal film 1401*b*. In the nip portion, a heat is applied to the conveyed transfer material 1301 from the heater 1403 through the metal film 1401*b* and the transfer material is fixed by a pressure in the nip portion.

The invention is made by considering the above points and intends to provide an image forming apparatus and an image forming method in which a defect regarding an image such as a tail occurring in a fixing step can be eliminated in consideration of a difference of a kind of transfer material. The image forming apparatus and the image forming method of the invention provide the following constructions.

An image forming apparatus which has an exposing portion adapted to expose an image bearing member charged by a charging portion based on image information, thereby forming an electrostatic latent image onto the image bearing member and a developing portion adapted to develop the electrostatic latent image formed by the exposing portion by a toner, thereby forming a visible image, and in which transfer paper, on which the visible image formed by the developing portion has been transferred, is conveyed to a fixing portion, and the visible image is fixed onto the transfer paper by the fixing portion by a heat and a pressure, comprising: an extracting portion adapted to extract a lateral line image information of a lateral line image extending in a main scanning direction from the image information; a control portion adapted to control a light emission amount of the exposing portion, so as to control an amount of the toner which is developed based on the lateral line image information extracted by the extracting portion in order to prevent a scattering of the toner associated with evaporation of moisture contained, in the transfer paper at the time when the lateral line image, which is based on the lateral line image information, is fixed by the fixing portion; and an obtaining portion adapted to obtain paper kind information representing a kind of transfer paper on which the lateral line image is fixed by the fixing portion, wherein the control portion executes the control of the light emission amount differently according to the paper kind information in order to prevent the scattering of the toner associated with the evaporation of the moisture contained in the transfer paper.

An image forming method for an image forming apparatus which has an exposing process for exposing an image bearing member charged by a charging portion based on image information, thereby forming an electrostatic latent image onto the image bearing member and a developing process for developing the electrostatic latent image formed by the exposing process by a toner, thereby forming a visible image, and in which transfer paper, on which the visible image formed by the developing process has been transferred, is conveyed to a fixing portion, and the visible image is fixed onto the transfer paper by the fixing portion by a heat and a pressure, comprising: extracting a lateral line image information of a lateral line image extending in a main scanning direction from the image information; controlling a light emission amount in the exposing step, so as to control an amount of the toner which is developed based on the lateral line image information extracted by the extracting step in order to prevent a scattering of the toner associated with evaporation of moisture contained, in the transfer paper at the time when the lateral line image, which is based on the lateral line image information, is fixed by the fixing portion; and obtaining paper kind information representing a kind of transfer paper on which the lateral line image is fixed by the fixing portion, wherein the control step executes the control of the light emission amount differently according to the paper kind information in order to prevent the scattering of the toner associated with the evaporation of the moisture contained in the transfer paper.

According to the invention, a defect regarding an image such as a tail occurring in the fixing step can be eliminated in consideration of a difference of the kind of transfer paper.

Further features of the present invention will become apparent from the following description of exemplary embodiments with reference to the attached drawings.

BRIEF DESCRIPTION OF THE DRAWINGS

FIG. 5 is a table illustrating a ratio of thin-out of the thin-out processes in the image forming apparatus according to the invention.

DESCRIPTION OF THE EMBODIMENTS

Each exemplary embodiment of the invention will be described hereinbelow with reference to FIGS. 1 to 7. However, component elements disclosed in the embodiments are illustrated as examples and a scope of the invention is not limited only to those component elements.

Embodiment 1

First, the first embodiment of the invention will be described with reference to FIGS. 1 to 4 and 7.

Figure 7:
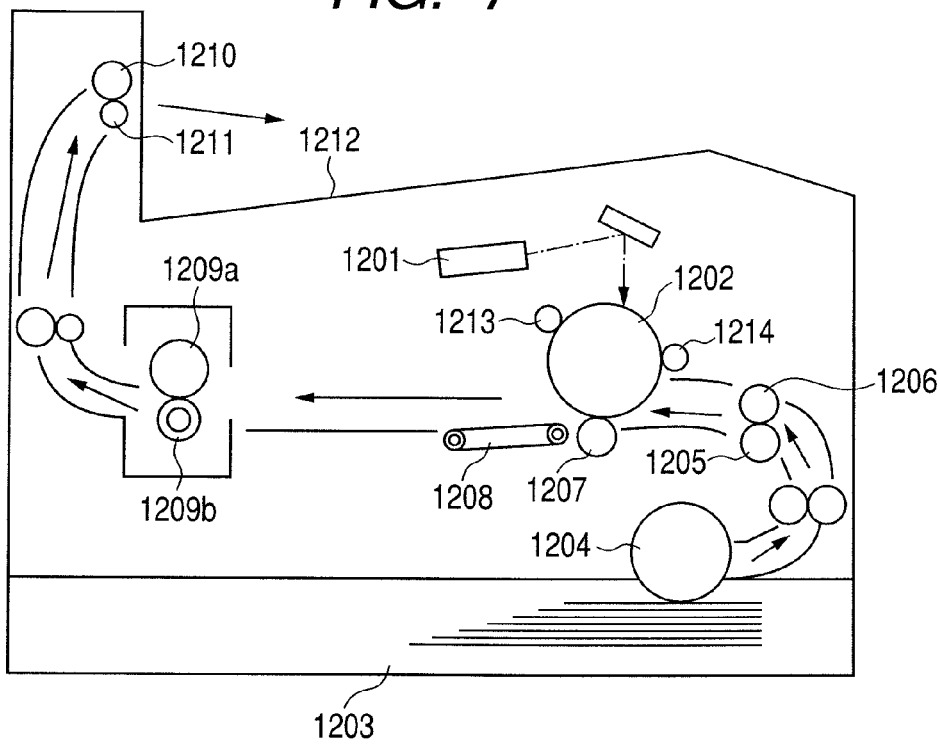
FIG. 7 is a schematic cross sectional view of a laser beam printer (LBP) as an image forming apparatus according to the invention.
Figure 8:
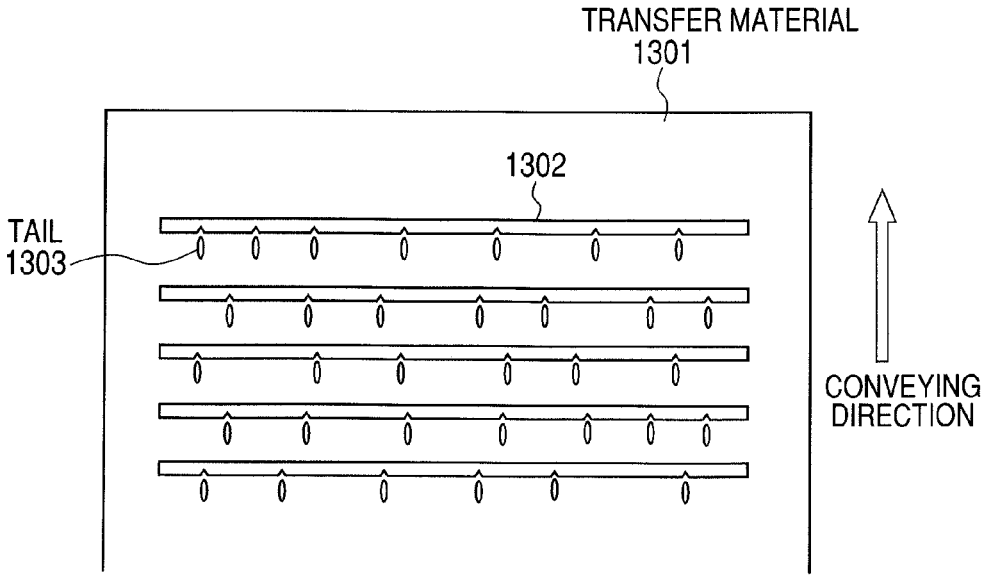
FIG. 8 is a diagram illustrating a tail phenomenon in an image forming apparatus in the related art.
Figure 9:
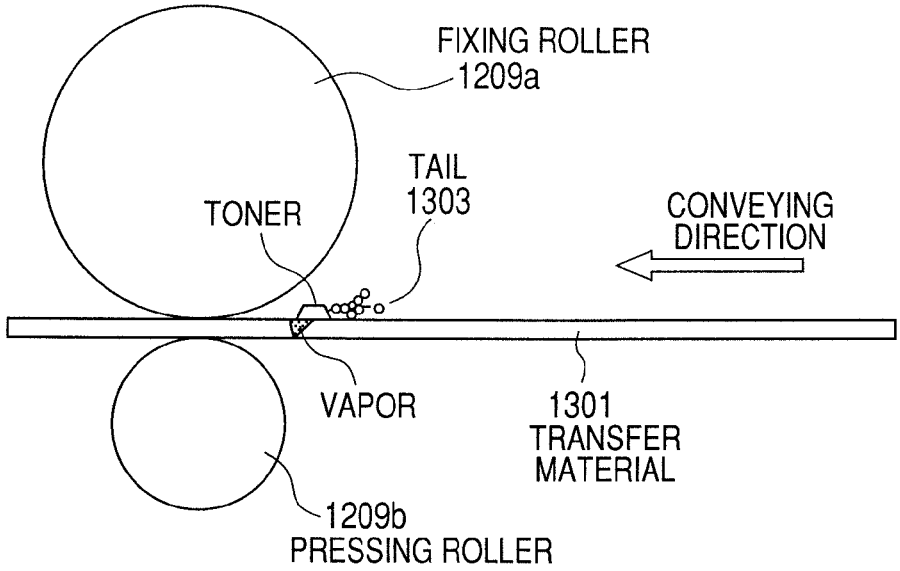
FIG. 9 is a simplified diagram illustrating a tail phenomenon occurring mechanism in the image forming apparatus in the related art.
Figure 10:
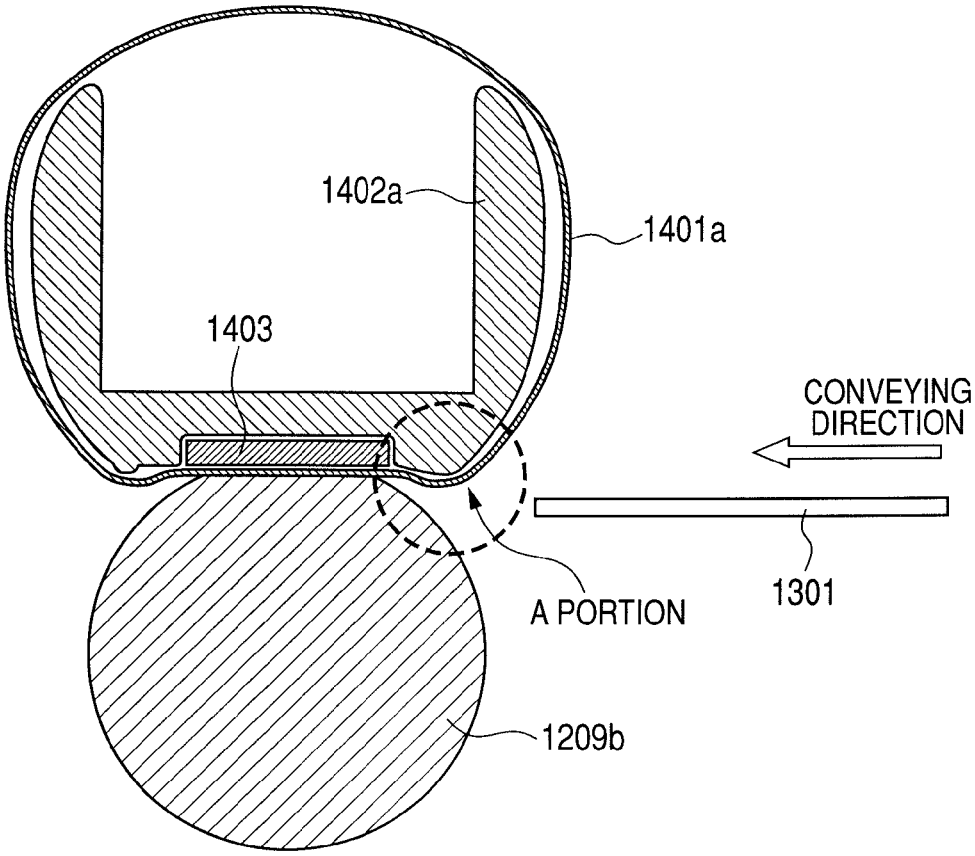
FIG. 10 is a schematic cross sectional view of a film heating and fixing apparatus using a resin film in the related art.
Figure 11:
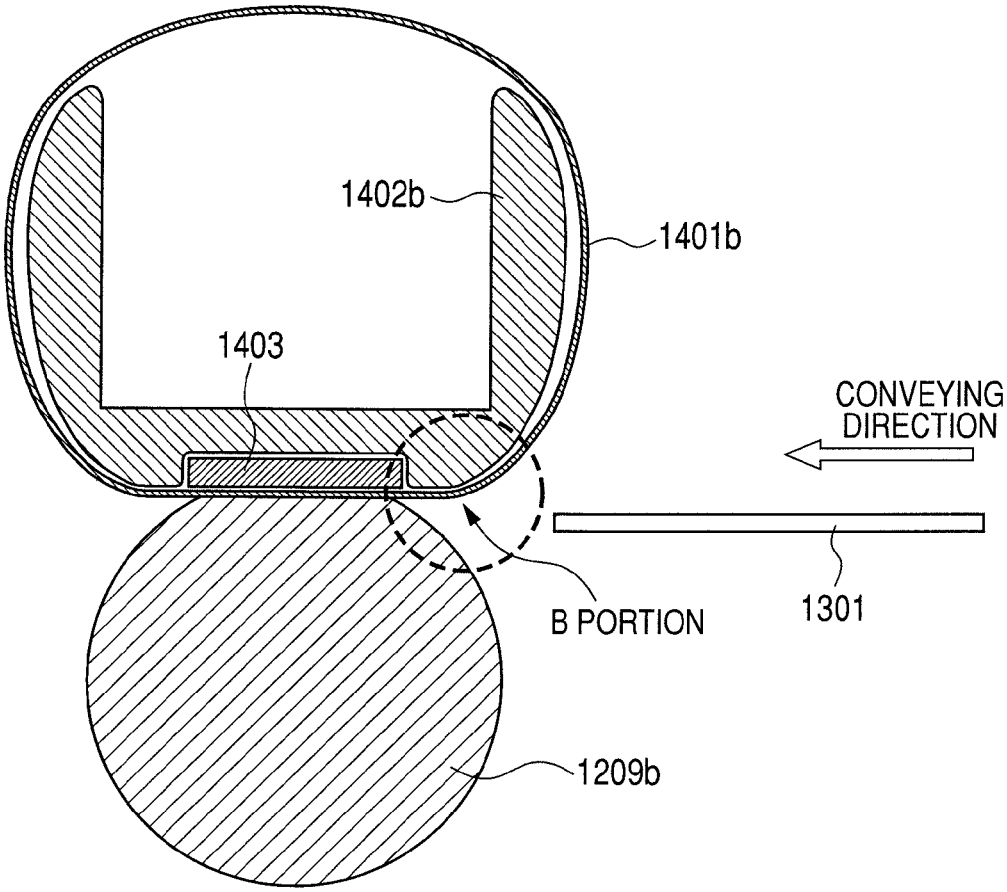
FIG. 11 is a schematic cross sectional view of a film heating and fixing apparatus using a metal film in the related art.

FIG. 7 is a vertical side sectional view illustrating a schematic construction of a laser beam printer (LBP) as an image forming apparatus according to the invention.

A photosensitive drum 1202 (image bearing member) is uniformly charged by a charging roller 1213 (charging unit). After that, based on an image signal (also referred to as image information) included in data of a print job transmitted from a host computer (not shown), a scanner 1201 (exposing unit) modulates an intensity of a laser beam, thereby forming an electrostatic latent image onto the photosensitive drum 1202 (onto the image bearing member). Toner is deposited onto the electrostatic latent image on the photosensitive drum 1202 by a developing roller 1214 (developing unit), thereby forming a toner (developer) image (visible image).

Transfer materials in an enclosing cassette 1203 are picked up one by one by a feed roller 1204 and writing timing is adjusted by registration rollers 1205 and 1206. Although only one enclosing cassette (also called a sheet feeding cassette, a sheet feeding tray, or the like) has been illustrated in the diagram, a plurality of enclosing cassettes in which various kinds of transfer materials have been enclosed may be actually and previously attached in a laser beam printer main body.

The toner image on the photosensitive drum 1202 is transferred onto the transfer material by a transfer roller 1207. After that, the toner image on the transfer material passes through a conveying belt 1208, the fixing roller 1209*a*, and the pressing roller 1209*b* and becomes a permanent fixed image. The transfer material is stacked onto a tray 1212 by discharge rollers 1210 and 1211.

Figure 1:
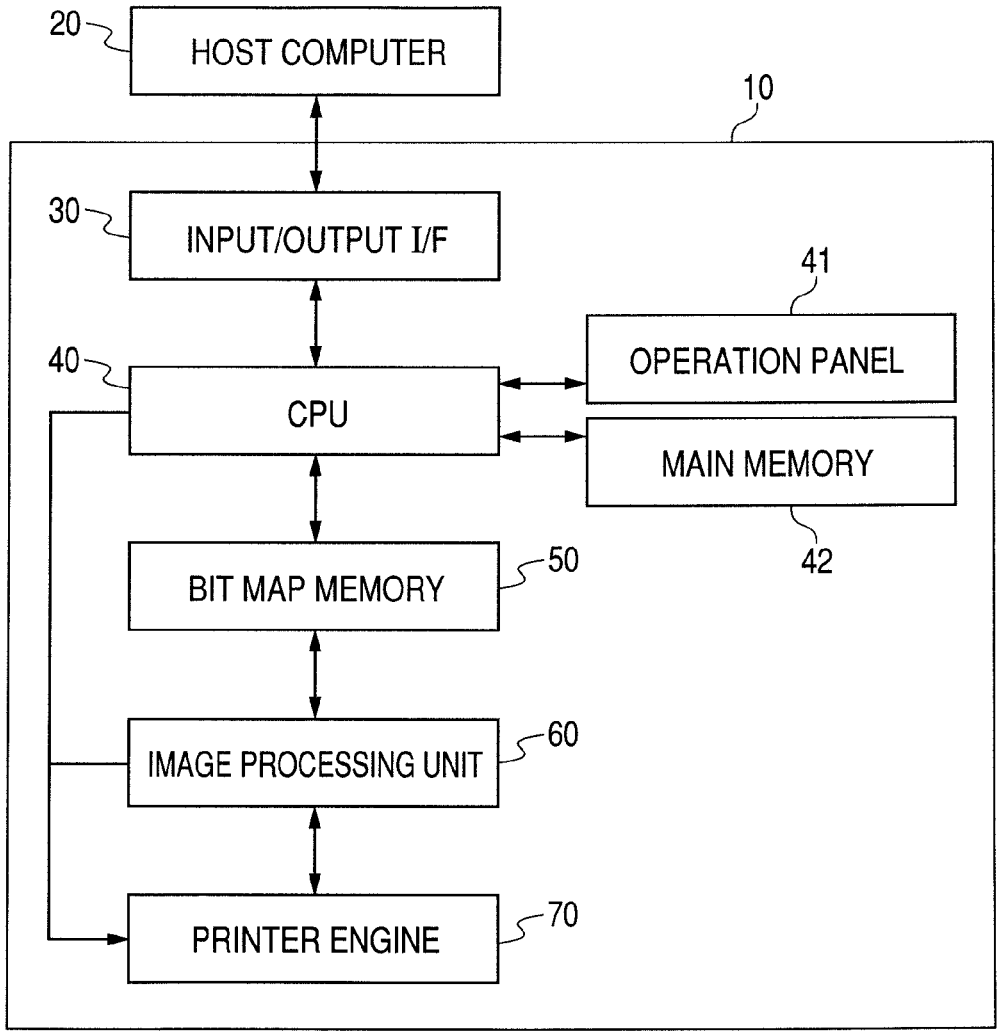
FIG. 1 is a block diagram illustrating a construction of an image forming apparatus according to the invention.

FIG. 1 is a block diagram illustrating a construction of the LBP as an image forming apparatus according to the first embodiment of the invention. In the diagram, the image forming apparatus has a laser beam printer 10 (hereinbelow, simply referred to as a printer) and a host computer 20 as an image information generating source.

The printer 10 has an input/output I/F (interface) 30, a CPU (central processing unit) 40, an operation panel 41, a main memory 42, a bit map memory 50, an image processing unit 60, and a printer engine 70. The input/output I/F 30 receives a print job (including an image signal) from the host computer 20 and transmits status information from the printer 10 to the host computer 20. In the following description, it is assumed that in the case of disclosing the image signal or the image information, it is disclosed as an image signal or image information representing either the signal or information before or after various kinds of image processes are/were executed. The CPU (central processing unit) 40 controls the whole printer 10. The operation panel 41 is a panel which has operation buttons for allowing the operator to execute various kinds of operations and a display unit for displaying various kinds of information and which is used for the operator to operate the printer 10.

An operation processing procedures of the CPU 40, character patterns, and the like have been stored in the main memory 42. The bit map memory 50 is a memory in which a dot image of one page to be printed can be developed. The image processing unit 60 executes image processes to the input image information and is a characteristic construction of the invention and its details will be described hereinafter. The printer engine 70 prints the image onto the transfer material (onto transfer paper). As already described in FIG. 7, it is assumed that the various kinds of members such as scanner 1201, photosensitive drum 1202, developing roller 1214, fixing roller, and pressing roller are included in the printer engine 70. A CPU for the printer engine 70 is also provided for the printer engine 70 in order to control the various kinds of members.

Although the following processes are executed by one of the members such as image processing unit 60 and CPU 40, for example, a part of the processes of the CPU 40 may be executed by the image processing unit 60. A part or all of the processes of the image processing unit 60 may be executed by the CPU 40 or an ASIC (Application Specific Integrated Circuit) provided as a dedicated circuit.

Figure 2:
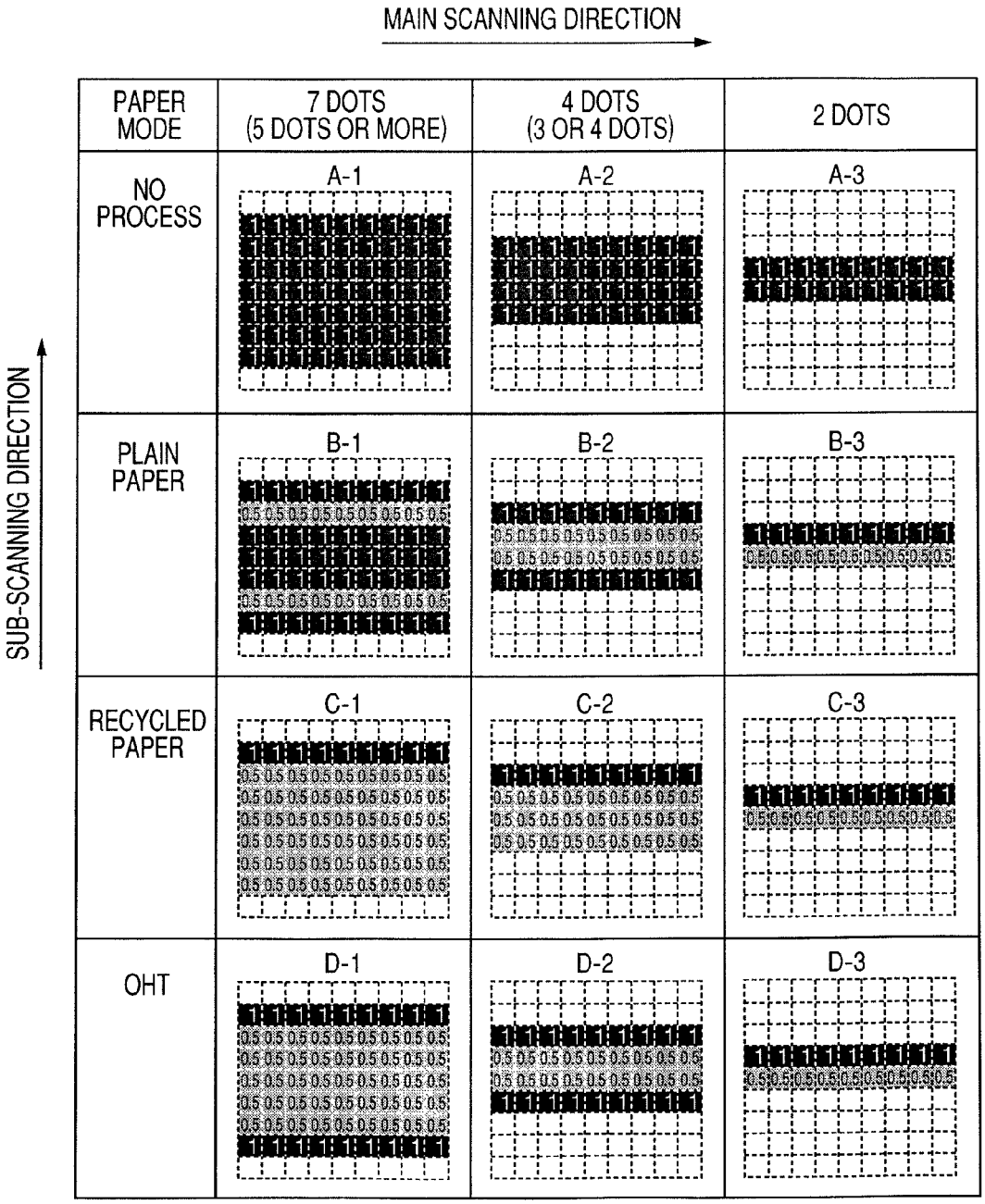
FIG. 2 is a diagram illustrating a list of thin-out processes in the image forming apparatus according to the invention.

FIG. 2 illustrates a list of thin-out processes according to the transfer material kinds and the image patterns. Information illustrated in FIG. 2 has been stored in the image processing unit 60 in FIG. 1 described above and is referred to by the image processing unit 60 prior to executing processes shown in a flowchart of FIG. 4, which will be described hereinafter. Or, the information illustrated in FIG. 2 may be stored into a non-volatile memory (not shown in FIG. 1) and referred to by the image processing unit 60.

In FIG. 2, the thin-out processes differ according to the transfer material kinds and the image patterns and each image processing pattern includes a lateral line image as a target of the thin-out process. The thin-out process denotes a process in which when the electrostatic latent image on the photosensitive drum 1202 is developed by the developing roller 1214 and the toner image is formed, a toner amount in a predetermined area is eventually reduced at a predetermined rate. Specifically speaking, for example, as will be described hereinafter, the thin-out process denotes a process in which an image process for reducing a concentration of the extracted image is executed, a light emission amount of the beam is decreased by making a laser pulse width variable, or the light emission amount is decreased by reducing a beam intensity.

In FIG. 2, "A" denotes an original image pattern in which the thin-out process is not executed; and "B", "C", and "D" denote the thin-out processes which are executed in the cases of plain paper, recycled paper, and an OHT (overhead transparency), respectively. The OHT here denotes a transparent film sheet for an overhead projector (OHP). A resin film is used as a base material of the OHT.

The plain paper and the recycled paper are defined as follows. As a typical index, the plain paper denotes paper in which a basic weight is equal to about 70 g/m$^2$ and a whiteness degree is equal to or larger than a predetermined value (for example, about 83% (ISO whiteness degree)). The recycled paper denotes paper in which wastepaper has been mixed, a basic weight is equal to about 70 g/m$^2$, and a whiteness degree is equal to or less than a predetermined value (for example, about 70% (ISO whiteness degree)). A basic weight of glossy paper or the like generally exceeds 20070 g/m$^2$. As for the plain paper and the recycled paper, as another definition, a wastepaper pulp compounding ratio can be used as a typical index. For example, the paper whose wastepaper pulp compounding ratio is equal to or larger than a predetermined value (for example, 70% or more) can be defined as recycled paper. There is also a case where the paper whose wastepaper pulp compounding ratio is equal to or larger than 20% or is equal to 100% can be defined as recycled paper. The paper in which no wastepaper pulp is mixed can be also defined as plain paper or the paper whose wastepaper pulp compounding ratio is equal to or less than a predetermined value (for example, 10%) can be also defined as plain paper. Both of the whiteness degree and the wastepaper pulp compounding ratio of the paper may be used as conditions at the time of classifying the paper into the plain paper or the recycled paper.

Subsequently, the various kinds of information in FIG. 2 will be described in detail.

"–1" as a branch number denotes that the image area (line width) in the sub-scanning direction is equal to or larger than 5 dots; "–2" the thin-out process in which the line width is equal to 3 to 4 dots; and "–3" the thin-out process in which the line width is equal to 2 dots. In FIG. 2, as for "–1" to "–3", the thin-out processes of 7 dot lines, 4 dot lines, and 2 dot lines are illustrated as typical examples, respectively. The dot line denotes a line formed by sequentially arranging dots in the main scanning direction. For example, the "7 dot lines" indicates an image pattern constructed by seven lines.

A numerical value "1" or "0.5" in a pixel denotes a thin-out ratio (predetermined ratio) of each pixel. A portion where the numerical value "0.5" is shown becomes the image area subjected to the thin-out process. In the embodiment, by executing the thin-out image process, a laser pulse width of one dot is made variable, thereby controlling an amount of developer.

Figure 3:
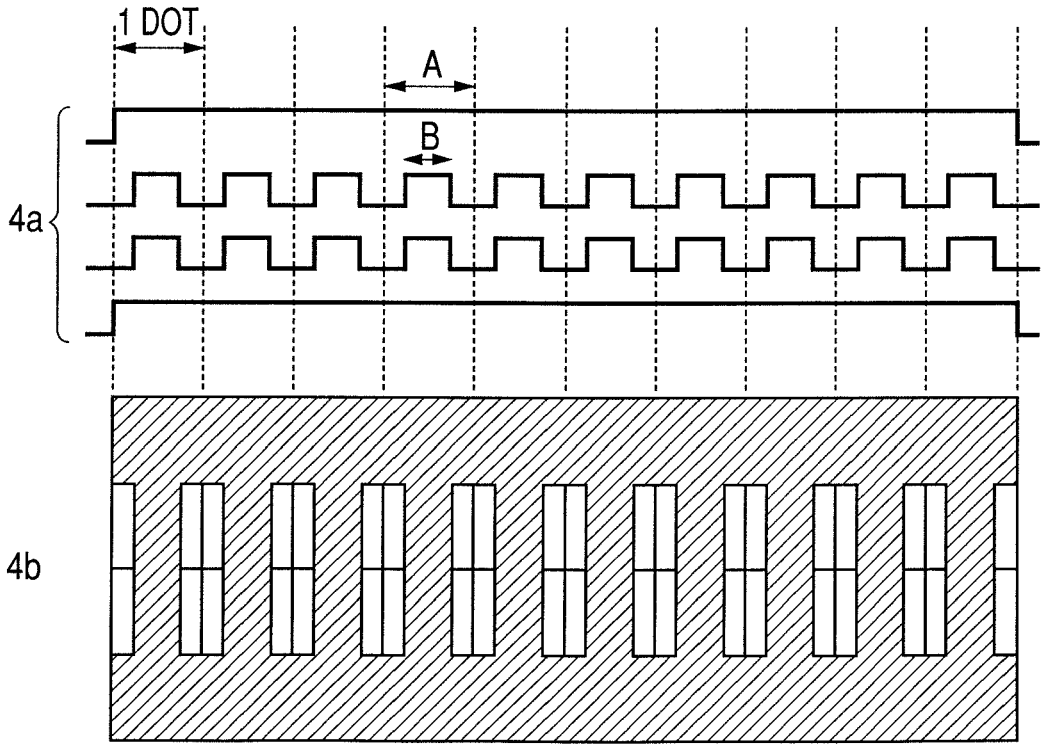
FIG. 3 is a diagram illustrating image information obtained after an image process in the image forming apparatus according to the invention.

Specifically speaking, "1" indicates the printing of a pulse width of 100% and "0.5" indicates the printing of a pulse width of 50%. For example, the thin-out process of B-2 in FIG. 2 is realized by a laser light emission as illustrated in FIG. 3. In a laser light emission pattern 4*a* in the main scanning direction in FIG. 3, a convex portion corresponds to a print portion and a concave portion corresponds to a non-print portion. In the diagram, a width A indicates the pulse width of 100% in one dot and a width B indicates the pulse width of 50% in one dot. That is, the laser light emission pattern 4*a* shows that the first line and the fourth line are printed by the pulse width of 100% and the second line and the third line are printed by the pulse width of 50%, respectively. By printing the laser light emission pattern 4*a*, an image pattern 4*b* is obtained.

Subsequently, B-1 to D-3 in FIG. 2 will be sequentially described.

First, with respect to the second line from the bottom and the second line from the top of the image pattern of the 7 dot lines, since an influence on the tail is large, a setting for thinning out by 50% is made (B-1). Similarly, with respect to the second line and the third line of the 4 dot lines, a setting for thinning out by 50% is made (B-2). For example, in the case of an image pattern constructed by 100 dot lines, the second line from the top and the $99^{th}$ line as a second line from the bottom are thinned out. In the case of an image pattern constructed by 2 dot lines, a setting is made to thin out the second line which exerts an influence on the tail (B-3).

In the recycled paper, in the case of an image pattern constructed by 7 dot lines, a setting is made to thin out the second line to the seventh line as a last line (C-1). Similarly, in the case of an image pattern constructed by 4 dot lines, a setting is made to thin out the second to fourth lines (C-2). In the case of an image pattern constructed by 100 dot lines, the second to 100th lines may be thinned out or the second line and the second to sixth lines from the bottom may be thinned out. In the case of extra-fine lines such as 2 dot lines, since a thin-out level is not changed irrespective of the transfer material kind, a thin-out process similar to that of the plain paper is executed (C-3).

In the case of the OHT, a setting is made to execute the thin-out process with respect to pixels existing inside of a line edge without executing the thin-out process with respect to pixels of the line edge (D-1, D-2). With respect to the 2 dot lines, a toner amount can be sufficiently reduced by the thin-out process similar to those of the plain paper and the recycled paper and the offset can be sufficiently reduced. Therefore, a setting is made to execute the thin-out process similar to that of the plain paper or the recycled paper (D-3).

A technical meaning of the thin-out processes illustrated in FIG. 2 of the embodiment will be described in detail hereinbelow.

(i) With Respect to the Occurrence of Tail and Offset Due to Difference of Transfer Material Kinds Generally, in the case of the recycled paper, not only a surface state of the paper is worse but also it is liable to absorb moisture and a resistance value is smaller as compared with those of the plain paper. Therefore, in the recycled paper, since an amount of vapor which is generated upon fixing is larger and a roughness degree of the paper is larger as compared with those of the plain paper, a ratio of occurrence of the tail (tail level) is higher. Such a fact appears in a relation between B-1 and C-1 and a difference of thin-out amounts of B-2 and C-2 in FIG. 2.

As also mentioned above, since the resin film is used as a base material in the case of the OHT, a moisture absorption does not occur. Even if the moisture is absorbed, its moisture absorption amount is sufficiently smaller than that of the plain paper or the recycled paper. Therefore, a tail level of the OHT is low. However, since a surface resistance is low due to an influence of a surface active agent coated on the surface, charges to be held on the reverse surface are liable to be removed and the offset is liable to occur. Therefore, in the recycled paper and the OHT, it is necessary to increase a thin-out amount more than the ordinary one, that is, widen an image area to be subjected to the thin-out process and reduce the toner amount as compared with the ordinary one.

As mentioned above, with respect to the plain paper or recycled paper as a first transfer material, the image process for the tail phenomenon which mainly takes the tail into consideration (predetermined processing method which can also avoid the offset) is executed. With respect to the first transfer material, it is necessary to prevent the scattering of the developer associated with the evaporation of moisture contained in the transfer paper at the time when the line image is fixed. The transfer materials which need to prevent the scattering of the developer as mentioned above can be further classified: for example, the plain paper may be defined as first transfer paper and the recycled paper may be defined as second transfer paper, or the like.

With respect to the OHT as a second transfer material, the image process for the offset phenomenon which mainly takes the offset phenomenon into consideration (predetermined processing method) is executed. Such a second transfer material can be also defined as a transfer material which does not need or hardly needs to prevent the scattering of the developer.

(ii) With Respect to the Occurrence of Decrease in Concentration and Hollow Lines Due to Difference of Transfer Material Kinds By reducing the toner amount by the thin-out process, the tail and offset can be improved. However, if the thin-out amount is too large, one of a concentration decrease and hollow lines occurs. For example, if the thin-out amount is determined so as to sufficiently reduce the tail in the recycled paper in which the tail is most liable to occur, the concentration decrease or hollow lines becomes remarkable in the plain paper. In the recycled paper, since a whiteness degree of the paper is low, even in the case of a similar toner amount, the concentration decrease on the paper is suppressed. Therefore, even if the thin-out amount in the recycled paper is set to be larger than that of the plain paper, there will be no problem. Similarly, in the OHT, since it is sufficient that the toner portion in the projection image is black, a slight concentration decrease does not cause a problem. However, as image quality, it is important that an image edge obtained when the image is projected is sharp. It is, therefore, necessary that the thin-out process is not executed with respect to the pixels of a line edge in the OHT.

Since the required characteristics and the quality differ depending on the transfer material kind as mentioned above, it is important to execute the thin-out process according to each transfer material kind. In the embodiment, three kinds of "plain paper", "recycled paper", and "OHT" are set as transfer material kinds and the thin-out processes are executed by different processing methods.

(iii) With Respect to Difference of Image Patterns

It has been known that the tail or offset occurs typically in a relatively thin line, for example, in an image pattern of about four to tens of dots. In the line within such a range, the difference due to the transfer material kinds appears typically. However, with respect to the extra-fine line such as two dot lines, the tail and offset levels are not changed irrespective of the transfer material kind. Therefore, if the thin-out process decided for the pattern in which the tail and offset are liable to occur is applied to all images, there is a case where the quality deteriorates in the two dot lines. In the embodiment, accordingly, the image patterns are classified into the three kinds of image patterns such as image pattern of 5 dots or more, image pattern of 3 to 4 dots, and image pattern of 2 dots, and the thin-out processes are set. Particularly, in the image pattern of 2 dots, the same thin-out process is set irrespective of the transfer material.

By the above reasons, in the embodiment, three kinds of "plain paper", "recycled paper", and "OHT" are set as transfer material kinds as illustrated in FIG. 2. The image patterns are also similarly classified into three kinds of image patterns such as image pattern of 5 dots or more in the sub-scanning direction, image pattern of 3 to 4 dots, and image pattern of 2 dots, and the thin-out processes are set. In the image pattern of 2 dots, the same thin-out process is set irrespective of the transfer materials. In other image patterns, the thin-out regions (areas) of the recycle paper and the OHT are set to be wider than that of the plain paper. In the OHT (D-1, D-2), the thin-out processes of the seventh line (in the case of −1) and the fourth line (in the case of −2) are not executed as compared with the recycled paper (C-1, C-2) This is because it is necessary that the image edge is sharp in the OHT as mentioned above.

Subsequently, a method of the thin-out process in the image processing unit 60 (thin-out processing unit) which functions as a control unit or an image processing unit will be described.

Figure 4:
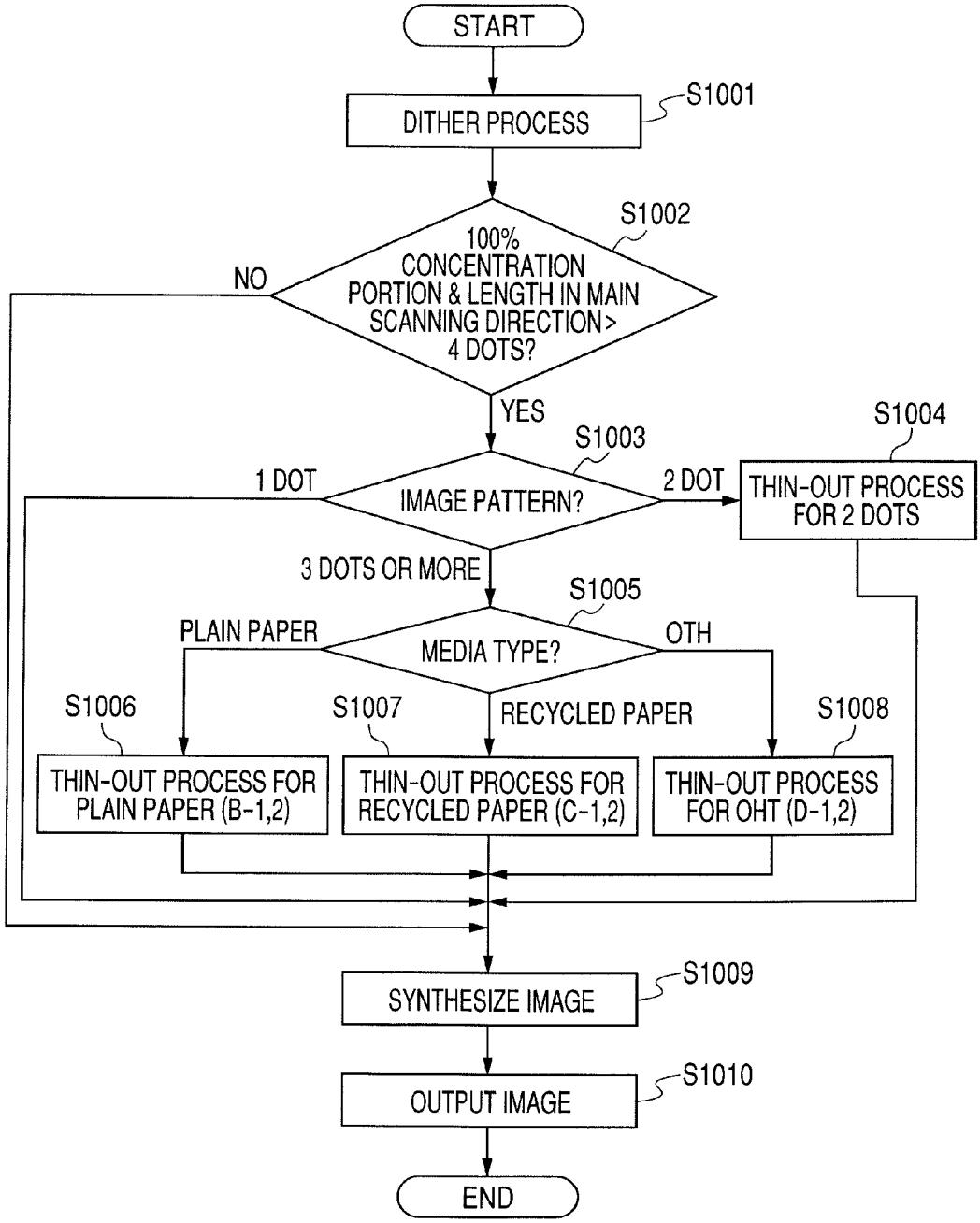
FIG. 4 is a flowchart illustrating a flow for the image processing operation in the image forming apparatus according to the invention.

FIG. 4 is a flowchart illustrating an operating procedure for controlling a light emission amount of the scanner 1201 as an exposing unit. This operating procedure is executed by the processes of the CPU 40 and the image processing unit 60. A series of operation will be described hereinbelow with reference to FIGS. 1 and 4.

The image information transmitted from the host computer 20 in FIG. 1 is converted into image data of a 1-dot unit in the bit map memory 50 in the printer 10. The converted image is transmitted to the image processing unit 60. The image processing unit 60 executes a logic calculation to the transmitted image information according to the flowchart of FIG. 4.

That is, first, in step S1001 (first image process) in FIG. 4, a predetermined image process which has been known hitherto is executed to the image information which has been input from an outside. This image process is executed to the whole visible image which is transferred onto the transfer material. As image processes, for example, there are a dither process, a smoothing process, and the like for improving gradation reproducibility of a halftone. For example, a technique for thinning out in order to improve light transmittance of the OHT has been known hitherto. A technique for executing a halftone process according to each media type (plain paper, recycled paper, thick paper, etc.) has been known by Japanese patent application Laid-Open No. 2007-062037. As another method, for example, a technique for executing a toner reduction according to a kind of image (object) has also been known by Japanese patent application Laid-Open Nos. 2004-230846 and 2002-166602. In the above documents, the image process for preventing such a situation that the scattering of the toner becomes conspicuous, particularly, in a fine line or character due to a defective fixing or defective transfer has been disclosed. As mentioned above, in the embodiment, the image process which has been well-known in the related art to the image information in order to improve the picture quality which gives no consideration to the tail and offset in the fixing apparatus is executed in step S1001.

In the flowchart of FIG. 4, the image process which is not aimed at reducing the tail and offset is executed first and, after that, the image processes (S1004, S1006 to S1008, etc.) which are aimed at reducing the tail and offset are executed. However, the invention is not limited to such a method. For example, after the image processes which give a consideration to the tail and offset, the image process (S1001) which is not aimed at reducing the tail and offset can be also executed. Or, an image process for reducing a toner adhering amount (developer amount) can be also simultaneously executed.

Subsequently, in step S1002 (second image process), an image which is a concentration portion of 100% and in which a length in the main scanning direction (direction which is perpendicular/almost perpendicular to the sheet conveying direction) is longer than a predetermined length (predetermined number of dots) is extracted. For example, 4 dots can be applied as a predetermined length. It is because an image which is short in the main scanning direction is a dot rather than a line and the tail is very difficult to occur. Generally, the tail phenomenon is liable to occur particularly in an image of 600 dpi in a range of 4 to 8 dots and when a width in the sub-scanning direction of the line is equal to 190 to 380 μm. The tail phenomenon can occur typically in the case where a width in the main scanning direction is equal to a line length of 5 mm or more. As mentioned above, upon extraction of the image information, actually, the image pattern in which the length in the sub-scanning direction as a conveying direction of the transfer material is equal to or larger than the first length and the length in the main scanning direction perpendicular to the conveying direction of the transfer material is equal to or larger than the second length (for example, 2 dots or more) is used as a target as described in FIG. 2.

Generally, as an image which is extracted as a 100% concentration portion, there are a line image, a character image, a solid image having predetermined lateral width and vertical width, and the like. Although the 100% concentration portion mentioned here indicates a black image in the case of a monochromatic image of binary data, in an image of multi-value data, the concentration is not always necessary to be equal to 100%. For example, an image having such a high concentration (for example, 70% or more) that the tail or the like can occur may be used as a target of the extraction (YES in step S1002).

The image data of the image which is not the 100% concentration portion (or the high concentration) or the image data whose length in the main scanning direction is less than the predetermined number of dots is transmitted to an image synthesizing unit without executing the thin-out process. The image data extracted as an image of the 100% concentration (or the high concentration) and the image data extracted as an image whose length in the main scanning direction is equal to or larger than the predetermined number of dots is further classified in detail according to its image pattern (image width in the sub-scanning direction) in step S1003.

If the image data is constructed by one dot, an image synthesizing process is executed without executing the thin-out process (step S1009). If the image data is constructed by two dots, the thin-out process for 2 dots in step S1004 is executed and, thereafter, the image data is transmitted to the image synthesizing unit (step S1009).

If the image data is constructed by three or more dots, the processing routine advances to next step S1005.

The transfer material kind is discriminated in step S1005. This discrimination is made by a method whereby the CPU 40 obtains (refers to) information representing the kind of transfer material (transfer paper) onto which the visible image is actually transferred and recognizes the obtained information. The information representing the kind of transfer material may be obtained by a method whereby, for example, information representing the kind of recording material which has previously been associated with an enclosing tray on which the transfer materials are stacked is preliminarily stored into a non-volatile memory (not shown) and the CPU 40 obtains it. As a method of setting the information representing the kind of recording material in association with the enclosing tray, for example, it may be set in response to an operating instruction of the user through the operation panel 41 or in response to an instructing command from an external host computer. As another obtaining method, for example, the CPU 40 may obtain the information representing the kind of transfer material based on a detection result of a transfer material sensor (not shown) provided in the printer.

The information representing the discriminated transfer material kind and image pattern kind is referred to in FIG. 2 and processes for the accurate tail, offset, and the like which can cope with the defective image are executed in steps S1006, S1007, and S1008. The processes in steps S1006, S1007, and S1008 correspond to the second image process. Particularly, in steps S1006 and S1007, the image process for reducing the image concentration of the extracted image pattern (including the lateral line image) is executed in order to prevent the scattering of the developer associated with the evaporation of the moisture contained in the transfer paper.

If the transfer material is the plain paper, the image data is subjected to the thin-out process for the plain paper in step S1006 and, thereafter, transmitted to the image synthesizing unit (step S1009). If the transfer material is the recycled paper or the OHT, the image data is also similarly subjected to the thin-out process for the recycled paper in step S1007 or the thin-out process for the OHT in step S1008 and, thereafter, transmitted to the image synthesizing unit (step S1009), respectively. That is, in step S1005 (changing unit), the thin-out process is changed to another thin-out process (S1006 to S1008) according to the kind of transfer material.

In step S1005, for example, the discrimination may be made by discriminating the information representing the transfer material kind designated in print job data sent from the host computer 20 or discriminating the information representing the transfer material kind designated by the user through the operation panel 41.

In step S1009, all image data of the image data subjected to the thin-out process in the previous steps and the image data which is not subjected to the thin-out process are sent to the image synthesizing unit, are synthesized, and become one sheet of image. In next step S1010, the image synthesized in step S1009 is sent to an image output unit and output to the printer engine 70. After that, the processing operation is finished. The printer engine 70 to which the image has been transmitted executes a laser beam light emission (exposure) based on the image sent from the scanner 1201 and, subsequently, executes the well-known image creation.

In the embodiment, the thin-out ratio in one pixel has been set to the same value such as 50% in all conditions and the area where the thin-out process is executed is made variable according to the transfer material and the image pattern. However, the invention is not limited to such a construction. For example, the thin-out area may be fixed and the thin-out ratio (concentration) may be made variable.

According to the embodiment, even if the transfer material kind changes, the stable image quality can be realized in correspondence to the various image patterns.

Particularly, the invention is very useful in the case where on the upstream side of the nip portion, that is, at a position before the transfer material reaches the nip portion, a belt which rotates along the slide member (heater) of the fixing apparatus has such a curvature that it is not projected to a portion lower than the nip portion and a pre-heating cannot be performed.

Embodiment 2

Subsequently, the second embodiment of the invention will be described with reference to FIGS. 5 and 6.

Since a whole construction (FIG. 7) and functions of an image forming apparatus in the embodiment are similar to those in the first embodiment, their description is omitted and points different from the first embodiment will be described.

In the defective images such as tail and offset, the level changes due to some factors besides the kind of transfer material. One of the factors is the foregoing toner amount. There is a plurality of parameters regarding the toner amount. As typical parameters, there are a charging bias and a developing bias. The charging bias or developing bias is applied as a predetermined value (refer to FIG. 5) to the charging roller 1213 or developing roller 1214 by a high voltage power source apparatus (not shown). The applied bias becomes a bias of the charging roller 1213 or developing roller 1214. There is a case where in order to properly keep the image quality such as image concentration, line width, and the like, the charging bias and the developing bias are automatically switched under control of the printer engine according to, for example, various conditions such as the number of sheets and the like. There is often a case where the user can switch the charging bias and the developing bias so as to obtain desired concentration and line width.

As another factor, there is a use environment. Since the tail is caused by the vapor from the paper as mentioned above, the tail is liable to occur in an environment of a high temperature and high humidity where a moisture amount of the paper is large. Besides the vapor, the parameters such as resistance value of the paper, charge amount of the toner, and the like which contribute to a Coulomb force which acts on the toner are changed depending on the temperature and humidity of the atmosphere. Generally, since the resistance of the paper is low and the charge amount of the toner is also small under the high temperature and high humidity, it is disadvantageous for the tail and offset.

In order to keep the proper image quality even in the case where such various conditions have changed, in the embodiment, in addition to the transfer material kind and the image pattern, the thin-out process is made variable according to the environment conditions, charging bias conditions, and developing bias conditions.

The thin-out process will be described in detail with reference to FIGS. 5 and 6.

In the embodiment, the area where the thin-out process is executed is made variable according to the transfer material kind and the image pattern and the thin-out ratio (predetermined ratio) in one pixel is made variable according to the environment conditions, charging bias conditions, and developing bias conditions. The difference of the thin-out areas according to the transfer material kind and the image pattern is similar to that in the embodiment 1 illustrated in FIG. 2.

FIG. 5 illustrates a table of the thin-out ratio in one pixel according to the environment conditions, charging bias conditions, and developing bias conditions. In the embodiment, the charging bias conditions and the developing bias conditions are set to three kinds of A, B, and C, respectively. Ranges of the charging biases A, B, and C are set to −650V or less, −650 to −450 V, and −450V or more, respectively. Ranges of the developing biases A, B, and C are set to −150V or more, −300 to −150 V, and −300V or less, respectively. That is, both of the charging biases and the developing biases are set so that the toner amount increases in order of A, B, and C. The environment conditions are also similarly set to three kinds of conditions: the moisture amount in the temperature and humidity of the atmosphere is less than 5.0 $g/m^3$, 5.0 to 15.0 $g/m^3$, and larger than 15.0 $g/m^3$, respectively. The moisture amount here is unconditionally obtained by an arithmetic operation from the temperature and humidity. The temperature and humidity as environment conditions are detected by an environment detecting unit (not shown) provided for the image forming apparatus. The thin-out processing method is changed according to a detection result.

Figure 6:
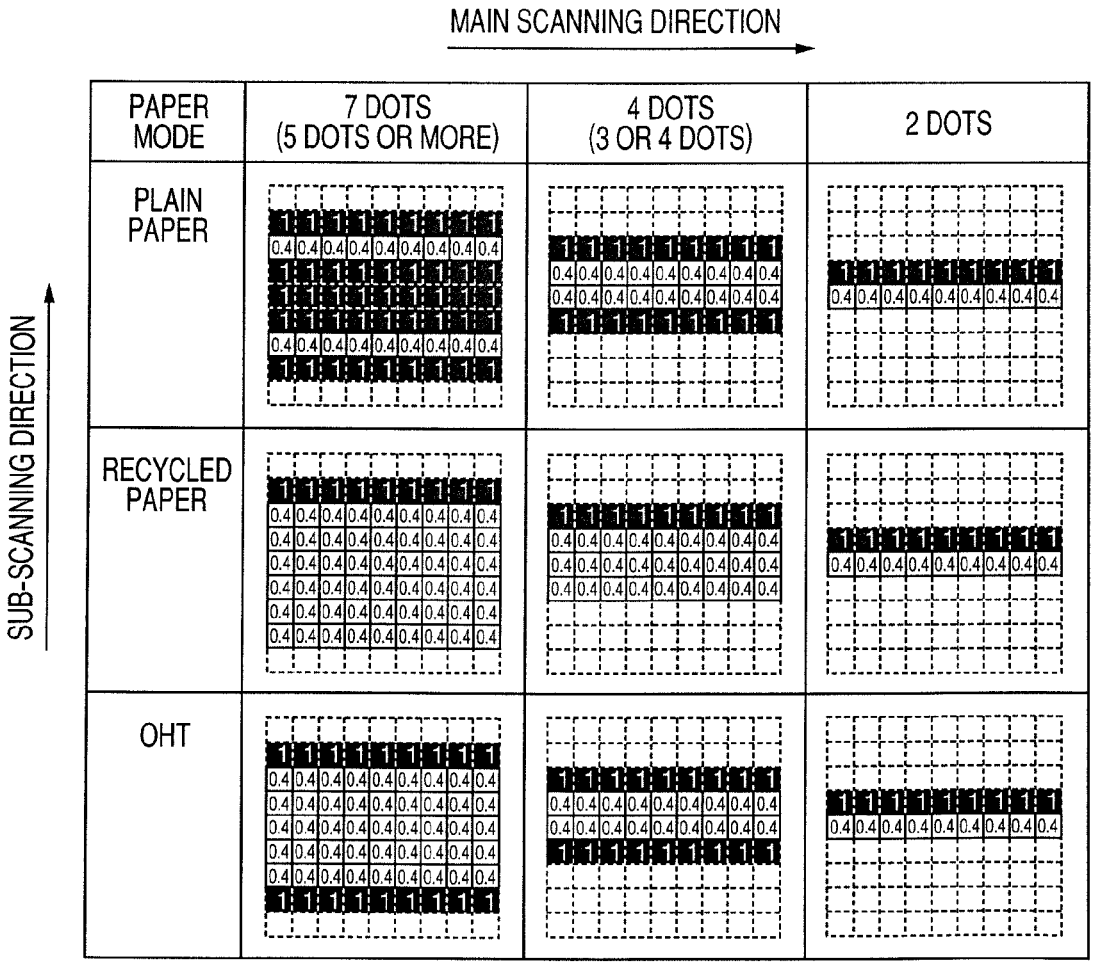
FIG. 6 is a diagram illustrating a list of thin-out processes in the image forming apparatus according to the invention.

FIG. 6 illustrates a list of the thin-out processes of every transfer material and every image pattern in the case where the charging condition C, the developing condition A, and the environment condition (moisture amount) larger than 15.0 $g/m^3$. Under the above conditions, the thin-out ratio is set to "0.4" and the laser pulse width in the thin-out area is equal to 40%.

According to the embodiment, even if the various kinds of conditions change, the stable image of high quality can be always provided.

Although the moisture amount has been used as an environment parameter in the above description, for example, only the temperature may be used as an environment parameter. In such a case, it is sufficient that the numerical values in the column of the environment conditions in FIG. 5 are set to "lower than 15° C.", "15-25° C.", "higher than 25° C." in order from the left. Although the image forming operation has been executed by combining all of the charging condition, developing condition, and environment condition in the above embodiment, the image forming operation can be also individually executed under each of those conditions.

Embodiment 3

In the embodiment, as a method of changing the thin-out process according to the various conditions, the laser power has been made variable and the exposure light amount has been changed.

In the embodiment 1, the thin-out area has been made variable according to the transfer material kind. In the embodiment 2, the laser pulse width (laser light emission time) in the thin-out area has been made variable according to the charging condition, developing condition, and environment condition. According to the methods of the thin-out process as mentioned in the embodiments 1 and 2, since it is necessary to extract, modify, and synthesize the image data, there is a fear that the image processes become complicated and a print speed decreases.

In the embodiment, therefore, the thin-out process is changed by making the laser power variable without executing the image processes as described in the embodiments 1 and 2. More specifically speaking, in steps S1006, S1007, and S1008 in FIG. 4, the gradation according to FIG. 2 is realized by changing the laser power instead of the image process. That is, it is sufficient to change the laser power to 100% or 50% in correspondence to "1" or "0.5" in the pixel in FIG. 2. In this case, for example, if the user wants to set the laser power to 50%, a control signal for instructing such a request is input to the scanner 1201. Since an electric potential of the exposing portion on the photosensitive drum also changes by changing the laser power as mentioned above, the toner amount changes and the tail and offset levels can be improved.

Since it is actually very difficult to make the laser power variable every dot, it is desirable to apply such a method to a portion of the process which is changed on a page unit basis.

Thus, since a part of the processes of the image data as a thin-out process can be reduced or it is unnecessary to process the image data, a burden on the processes is lightened and the print speed is not obstructed.

Other Embodiments

The processes of steps S1002 to S1009 illustrated in FIG. 4 are executed by the image processing unit 60 in the embodiments 1 to 3. However, the processes of steps S1002 to S1009 in FIG. 4 may be executed in the printer engine 70 in FIG. 1. In this case, since the image synthesis in step S1009 is executed in the printer engine 70, the image outputting process in S1010 which has been executed to the printer engine 70 by the image processing unit 60 becomes unnecessary.

The processes of steps S1001 to S1009 illustrated in FIG. 4 are executed by the host computer 20 in FIG. 1. In this case, after the host computer 20 executed the image synthesis in S1009, the image outputting process is executed from the host computer 20 to the printer 10 in S1010.

Even by the construction as mentioned above, it is possible to cope with the defective image occurring in the fixing step in consideration of the difference of the transfer material kinds.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese patent application No. 2007-283755, filed Oct. 31, 2007, and Japanese patent application No. 2008-258311, filed Oct. 3, 2008, which are hereby incorporated by reference herein in their entirety.

What is claimed is:

1. An image forming apparatus which has an exposing portion adapted to expose an image bearing member charged by a charging portion based on image information, thereby forming an electrostatic latent image onto the image bearing member and a developing portion adapted to develop the electrostatic latent image formed by the exposing portion by a toner, thereby forming a visible image, and in which transfer paper, on which the visible image formed by the developing portion has been transferred, is conveyed to a fixing portion, and the visible image is fixed onto the transfer paper by the fixing portion, comprising:

an extracting portion adapted to extract lateral line image information of a lateral line image extending in a main scanning direction from the image information;

a control portion adapted to control a light emission amount of the exposing portion, so as to control an amount of the toner which is developed based on the lateral line image information extracted by the extracting portion in order to prevent a scattering of the toner associated with evaporation of moisture contained in the transfer paper at the time when the lateral line image, which is based on the lateral line image information, is fixed by the fixing portion; and an obtaining portion adapted to obtain paper kind information representing a kind of transfer paper on which the lateral line image is fixed by the fixing portion, wherein the control portion executes the control of the light emission amount differently according to the paper kind information in order to prevent the scattering of the toner associated with the evaporation of the moisture contained in the transfer paper, and wherein when a kind of transfer material indicates transfer paper, the control portion executes an image process for a tail phenomenon as the control of the light emission amount, and when the kind of transfer material indicates an overhead transparency, the control portion executes an image process for an offset phenomenon in which a toner image is electrostatically transferred to the fixing portion as the control of the light emission amount.

2. An apparatus according to claim 1, wherein the control portion functions as an image processing portion, the process for controlling the light emission amount of the exposing portion is an image process for the lateral line image, and wherein the image processing portion executes a first image process for changing an amount of toner which is transferred when the paper kind information indicates a first transfer paper and executes a second image process for changing an amount of toner which is transferred when the paper kind information indicates a second transfer paper.

3. An apparatus according to claim 1, wherein the control portion makes the control of the light emission amount different based on the paper kind information and a line width of the extracted lateral line image information.

4. An apparatus according to claim 1, wherein the transfer paper includes plain paper, in which a whiteness degree of the paper is equal to or larger than a predetermined value or a compounding ratio of wastepaper pulp is equal to or less than a predetermined value, and recycled paper, in which a whiteness degree of the paper is equal to or less than a predetermined value or a compounding ratio of wastepaper pulp is equal to or larger than a predetermined value.

5. An apparatus according to claim 1, wherein the extracting portion extracts the lateral line image information in which a length in a sub-scanning direction as a conveying direction of the transfer paper is equal to or larger than a first length and a length in a main scanning direction is equal to or larger than a second length.

6. An apparatus according to claim 1, further comprising:

an environment detecting portion adapted to detect an environment of an atmosphere, wherein in order to prevent the scattering of the toner associated with the evaporation of the moisture contained in the transfer paper, the control portion makes the control of the light emission amount different based on the paper kind information and a detection result of the environment detecting portion.

7. An image forming apparatus which has an exposing portion adapted to expose an image bearing member charged by a charging portion based on image information, thereby forming an electrostatic latent image onto the image bearing member and a developing portion adapted to develop the electrostatic latent image formed by the exposing portion by a toner, thereby forming a visible image, and in which transfer paper, on which the visible image formed by the developing portion has been transferred, is conveyed to a fixing portion, and the visible image is fixed onto the transfer paper by the fixing portion, comprising:

an extracting portion adapted to extract lateral line image information of a lateral line image extending in a main scanning direction from the image information;

a control portion adapted to control a light emission amount of the exposing portion, so as to control an amount of the toner which is developed based on the lateral line image information extracted by the extracting portion in order to prevent a scattering of the toner associated with evaporation of moisture contained in the transfer paper at the time when the lateral line image, which is based on the lateral line image information, is fixed by the fixing portion; and an obtaining portion adapted to obtain paper kind information representing a kind of transfer paper on which the lateral line image is fixed by the fixing portion, wherein the control portion executes the control of the light emission amount differently according to the paper kind information in order to prevent the scattering of the toner associated with the evaporation of the moisture contained in the transfer paper, and wherein in order to prevent the scattering of the toner associated with the evaporation of the moisture contained in the transfer paper, the control portion makes the control of the light emission amount different based on the paper kind information and a bias applied to the charging portion or a bias applied to the developing portion.

8. An apparatus according to claim 1, wherein the fixing portion has a slide member, a supporting member for supporting the slide member, a belt which rotates along the slide member, and a pressing member for forming a nip portion together with the slide member through the belt, and at a position before the transfer paper reaches the nip portion, the belt has a curvature in which it is not projected to a portion lower than the nip portion.

9. An apparatus according to claim 1, wherein the process for controlling the light emission amount of the exposing portion is an image process for the lateral line image.

10. An image forming method for an image forming apparatus which has an exposing process for exposing an image bearing member charged by a charging portion by an exposing portion based on image information, thereby forming an electrostatic latent image onto the image bearing member and a developing process for developing the electrostatic latent image formed by the exposing process by a toner, thereby forming a visible image, and in which transfer paper, on which the visible image formed by the developing process has been transferred, is conveyed to a fixing portion, and the visible image is fixed onto the transfer paper by the fixing portion, comprising the steps of:

extracting lateral line image information of a lateral line image extending in a main scanning direction from the image information;

controlling a light emission amount in the exposing step according to the transfer paper kind obtained in the obtaining step, so as to control an amount of the toner which is developed based on the lateral line image information extracted by the extracting step in order to prevent a scattering of the toner associated with evaporation of moisture contained, in the transfer paper at the time when the lateral line image, which is based on the lateral line image information, is fixed by the fixing portion; and obtaining paper kind information representing a kind of transfer paper on which the lateral line image is fixed by the fixing portion, wherein the control step executes the control of the light emission amount differently according to the paper kind information in order to prevent the scattering of the toner associated with the evaporation of the moisture contained in the transfer paper, and wherein when a kind of transfer material indicates transfer paper, the control step executes an image process for a tail phenomenon as the control of the light emission amount, and when the kind of transfer material indicates an overhead transparency, the control step executes an image process for an offset phenomenon in which a toner image is electrostatically transferred to the fixing portion as the control of the light emission amount.

11. An image forming method for an image forming apparatus which has an exposing process for exposing an image bearing member charged by a charging portion by an exposing portion based on image information, thereby forming an electrostatic latent image onto the image bearing member and a developing process for developing the electrostatic latent image formed by the exposing process by a toner, thereby forming a visible image, and in which transfer paper, on which the visible image formed by the developing process has been transferred, is conveyed to a fixing portion, and the visible image is fixed onto the transfer paper by the fixing portion, comprising the steps of:

extracting lateral line image information of a lateral line image extending in a main scanning direction from the image information;

controlling a light emission amount in the exposing step according to the transfer paper kind obtained in the obtaining step, so as to control an amount of the toner which is developed based on the lateral line image information extracted by the extracting step in order to prevent a scattering of the toner associated with evaporation of moisture contained, in the transfer paper at the time when the lateral line image, which is based on the lateral line image information, is fixed by the fixing portion; and obtaining paper kind information representing a kind of transfer paper on which the lateral line image is fixed by the fixing portion, wherein the control step executes the control of the light emission amount differently according to the paper kind information in order to prevent the scattering of the toner associated with the evaporation of the moisture contained in the transfer paper, and wherein in order to prevent the scattering of the toner associated with the evaporation of the moisture contained in the transfer paper, the control portion makes the control of the light emission amount different based on the paper kind information and a bias applied to the charging portion or a bias applied to the developing portion.

* * * * *